US006052043A

United States Patent [19]

Gotoh et al.

[11] Patent Number: 6,052,043

[45] Date of Patent: Apr. 18, 2000

[54] THIN-FILM MULTILAYERED ELECTRODE, HIGH-FREQUENCY TRANSMISSION LINE, HIGH-FREQUENCY RESONATOR, AND HIGH-FREQUENCY FILTER

[75] Inventors: Yoshihiko Gotoh, Shiga-ken; Masato Kobayashi, Omihachiman; Katsuhiko Tanaka, Ibaraki, all of Japan

[73] Assignee: Murata Manufacturing Co., Ltd., Japan

[21] Appl. No.: 09/176,504

[22] Filed: Oct. 21, 1998

[30] Foreign Application Priority Data

Oct. 21, 1997 [JP] Japan ..... 9-288748

[51] Int. Cl.[7] ..... H01P 1/203; H01P 3/08; H01P 7/08

[52] U.S. Cl. ..... 333/204; 333/219; 333/238

[58] Field of Search ..... 333/204, 219, 333/238, 246

[56] References Cited

U.S. PATENT DOCUMENTS

| | | | |
|---|---|---|---|
| 2,879,183 | 3/1959 | Doherty et al. | 427/118 |
| 5,770,988 | 6/1998 | Goto et al. | 333/236 |
| 5,920,243 | 7/1999 | Ishikawa et al. | 333/204 |
| 5,920,244 | 7/1999 | Kobayashi et al. | 333/219 |

FOREIGN PATENT DOCUMENTS

| | | |
|---|---|---|
| 0735606 | 10/1996 | European Pat. Off. . |
| 0786822 | 7/1997 | European Pat. Off. . |
| 8-265008 | 10/1996 | Japan . |

OTHER PUBLICATIONS

Patenet Abstracts of Japan, vol. 16, No. 539 (E–1289), Nov. 10, 1992 & JP 04 206607 A (Hitachi Maxell Ltd), Jul. 28, 1992, abstract.

Patent Abstracts of Japan, vol. 98, No. 4, Mar. 31, 1998 & JP 09 326608 A (Murata Mfg Co Ltd), Dec. 16, 1997, abstract.

European Search Report dated Jan. 29, 1999.

*Primary Examiner*—Benny Lee
*Assistant Examiner*—Barbara Summons
*Attorney, Agent, or Firm*—Ostrolenk, Faber, Gerb & Soffen, LLP

[57] ABSTRACT

A thin-film multilayered electrode has a dielectric substrate; a ground conductor provided on a back surface of the dielectric substrate; and a plurality of thin-film conductive layers and dielectric layers alternately stacked on a front surface of the dielectric substrate. In one example, the ground conductor, one of the thin-film conductive layers in contact with the dielectric substrate and the dielectric substrate interposed therebetween form a TEM mode principal transmission line, and each thin-film dielectric layer and a pair of thin-film conductive layers sandwiching the thin-film dielectric layer form a TEM mode sub-transmission line. A thickness and a dielectric constant of each thin-film dielectric layer is set such that phase velocities of TEM waves which propagate through the TEM mode principal transmission line and the TEM mode sub-transmission lines are substantially identical with each other. A thickness of each thin-film conductive layer is set at a predetermined value which is smaller than a skin depth at a predetermined operating frequency such that electromagnetic fields between the TEM mode principal transmission line and its adjacent TEM mode sub-transmission line, and between each adjacent pair of TEM mode sub-transmission lines, are coupled with each other. At least one of the thin-film dielectric layers which is closest to the dielectric substrate has a thickness greater than that of the other thin-film dielectric layers.

10 Claims, 3 Drawing Sheets

THIN-FILM MULTILAYERED ELECTRODE, HIGH-FREQUENCY TRANSMISSION LINE, HIGH-FREQUENCY RESONATOR, AND HIGH-FREQUENCY FILTER

BACKGROUND OF THE INVENTION

1. Field of the Invention

The present invention relates to thin-film multilayered electrodes, and also relates to high-frequency transmission lines, high-frequency resonators, high-frequency filters, and the like which include the thin-film multilayered electrodes.

2. Description of the Related Art

With the recent advances in miniaturized electronic components, miniaturization of devices has been attempted also by using materials which have a high dielectric constant in high frequency bands such as microwaves, submillimeter waves, or millimeter waves. If dimensions are reduced by using materials having a high dielectric constant, however, energy loss increases inversely with the cube root of volume. Energy loss in high-frequency devices can be broadly classified into conduction loss caused by skin effects and dielectric loss caused by the dielectric materials. Recently dielectric materials having a high dielectric constant and at the same time low loss characteristics have been put to practical use, and thus conduction loss dominates energy loss in comparison with dielectric loss.

Under these circumstances, in PCT Patent Publication No. WO95/06336, the assignee of the present invention disclosed a thin-film multilayered electrode which is capable of decreasing conduction loss in the high frequency band, and also disclosed a method for designing an optimum thickness for each layer in the thin-film multilayered electrode at a specific operating frequency. FIG. 4 is a perspective view of a half-wavelength transmission line-type resonator 101 which includes a thin-film multilayered electrode 103 formed in accordance with the design method disclosed in PCT Patent Publication No. WO95/06336.

As shown in FIG. 4, the half-wavelength transmission line-type resonator 101 includes a dielectric substrate 102 provided with a ground conductor 106 on the entire back surface, and the thin-film multilayered strip electrode 103, placed on the dielectric substrate 102, having a length of $\lambda g/2$ ($\lambda g$ is a guide wavelength) in the longitudinal direction.

As illustrated in FIG. 5, in the thin-film multilayered electrode 103, a thin-film conductive layer 104*a* is formed on the surface of the dielectric substrate 102, and a thin-film dielectric layer 105*a* is deposited on the thin-film conductive layer 104*a*. Thenceforth, thin-film conductive layers 104*b*, 104*c*, and 104*d* and thin-film dielectric layers 105*b* and 105*c* are alternately stacked in that order to form the thin-film multilayered electrode 103. A length in the longitudinal direction of the thin-film multilayered electrode 103 is set at a half-wavelength of a desired frequency, enabling it to function as a resonator.

At this stage, a TEM mode microstrip line (hereinafter referred to as a principal transmission line) 107 is formed by the thin-film conductive layer 104*a*, the ground conductor 106 (FIG. 4), and the dielectric substrate 102. Also, on the principal transmission line 107, a TEM mode sub-transmission line is formed by the thin-film dielectric layer 105*a* interposed between a pair of thin-film conductive layers 104*a* and 104*b*. The thin-film dielectric layers 105*b* and 105*c* similarly form sub-transmission lines. With respect to the conventional thin-film multilayered electrode 103, by using the method disclosed in PCT Patent Publication No. WO95/06336, (a) a thickness and a dielectric constant $\in$ of each of the thin-film dielectric layers 105*a*, 105*b*, and 105*c* is set so that phase velocities of TEM waves which propagate through the principal transmission line 107 and the individual sub-transmission lines are substantially identical with each other; and (b) a thickness of each of the thin-film conductive layers 104*a*, 104*b*, and 104*c* is set at a predetermined thickness which is smaller than a skin depth of an operating frequency so that electromagnetic fields between the principal transmission line 107 and its adjacent sub-transmission lines and between the individual sub-transmission lines are coupled with each other.

Accordingly, a portion of high-frequency energy which flows through the principal transmission line 107 is transferred to the sub-transmission lines, and the high-frequency electric current flows through each of the thin-film conductive layers 104*a*, 104*b*, 104*c*, and 104*d*, and thus the skin effect of the electrode in the high-frequency region can be substantially suppressed.

In accordance with the thin-film multilayered electrode disclosed in PCT Patent Publication No. WO95/06336, the thickness of each thin-film conductive layer and thin-film dielectric layer is set on the precondition that the thin-film multilayered electrode be formed on a dielectric substrate 102 having a flat surface (for example, a mirror-polished sapphire substrate composed of single-crystal alumina).

In the case of using, for example, a ceramic substrate as a dielectric substrate, however, the surface of the substrate is uneven or rough because of the existence of pores or the like. Although the unevenness can be planarized up to a point by, for example, surface polishing treatment, the surface of the substrate cannot be polished sufficiently because there are many pores in the substrate as well as on the surface, and new pores may be exposed during the polishing treatment. FIG. 6 is a sectional view of a layered structure in which a thin-film multilayered electrode is formed on an uneven dielectric substrate. As shown in FIG. 6, each of the thin-film conducting layers and thin-film dielectric layers will be uneven in accordance with the unevenness of the substrate. If each layer is formed unevenly in such a manner, phase velocities of TEM waves which propagate through the principal line and the individual sub-transmission lines cannot be equalized as originally designed. Also, when thin-films are deposited on an uneven substrate, two adjacent thin-film conductive layers may easily be short-circuited during the deposition process. Such conditions interfere considerably with the effective suppression of the skin effect by the thin-film multilayered electrode.

SUMMARY OF THE INVENTION

The present invention overcomes the technical problems described above. It is an achievement of the present invention to provide a thin-film multilayered electrode in which, even when the thin-film multilayered electrode is formed on a dielectric substrate having an uneven surface, the skin effect is well suppressed in the thin-film multilayered electrode and individual thin-film conductive layers are not short-circuited to each other.

A thin-film multilayered electrode according to an aspect of the invention comprises: a dielectric substrate; a ground conductor provided on a back surface of the dielectric substrate; and a plurality of thin-film conductive layers and dielectric layers alternately stacked on a front surface of the dielectric substrate. The ground conductor, one of the thin-film conductive layers in contact with the dielectric substrate and the dielectric substrate interposed therebetween form a principal transmission line or resonator, and each thin-film dielectric layer and a pair of thin-film conductive layers sandwiching the thin-film dielectric layer form a sub-transmission line or sub-resonator. A thickness and a dielectric constant of each thin-film dielectric layer is set such that phase velocities of waves which propagate through the principal transmission line or resonator and the sub-transmission lines or sub-resonators are substantially identical with each other. A thickness of each thin-film conductive layer is set at a predetermined value which is smaller than a skin depth at a predetermined operating frequency such that electromagnetic fields between the principal transmission line or resonator and its adjacent sub-transmission line or sub-resonator, and between adjacent pairs of sub-transmission lines or sub-resonators, are coupled with each other.

At least one of the thin-film dielectric layers which is closest to the dielectric substrate has a thickness greater than that of the other thin-film dielectric layers.

The thin-film dielectric layer closest to the dielectric substrate preferably also has a dielectric constant greater than that of the other thin-film dielectric layers.

A sum of a thickness of the thin-film conductive layer in contact with the dielectric substrate and a thickness of the thin-film dielectric layer closest to the dielectric substrate is preferably at least 1.5 times as great as an average diameter of pores which exist on the front surface of the dielectric substrate.

According to another aspect of the invention, the thin-film dielectric layer closest to the dielectric substrate and a thin-film dielectric layer second closest to the dielectric substrate both have thicknesses greater than that of the other thin-film dielectric layers, and preferably greater dielectric constants as well.

A sum of a thickness of the thin-film dielectric layer closest to the dielectric substrate, a thickness of a thin-film dielectric layer second closest to the dielectric substrate, a thickness of the thin-film conductive layer in contact with the dielectric substrate and a thickness of one of the thin-film conductive layers between the thin-film dielectric layer closest to the dielectric substrate and the thin-film dielectric layer second closest to the dielectric substrate, is at least 1.5 times as great as an average diameter of pores which exist on the front surface of the dielectric substrate.

The thin-film multilayered electrode of the present invention may be used as a high-frequency transmission line, a high-frequency resonator, or a high-frequency filter.

For the purpose of illustrating the invention, there are shown in the drawings several forms which are presently preferred, it being understood, however, that the invention is not limited to the precise arrangements and instrumentalities shown.

DETAILED DESCRIPTION OF EMBODIMENTS OF THE INVENTION

Hereinafter, preferred embodiments of the present invention are explained in detail with reference to the drawings.

EXAMPLE 1

A thin-film multilayered electrode as a first example of the present invention will be described with reference to FIGS. 1 and 2.

Figure 1:
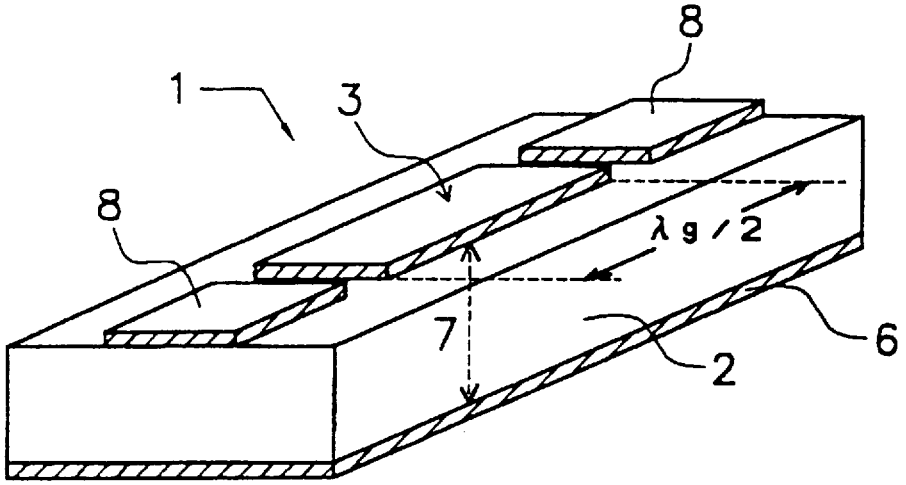
FIG. 1 is a perspective view of a resonator which includes a thin-film multilayered electrode as a first example of the present invention.

FIG. 1 is a perspective view of a half-wavelength transmission line-type resonator 1 which includes a thin-film multilayered electrode 3. The half-wavelength transmission line-type resonator 1 includes a dielectric substrate 2 provided with a ground conductor 6 on the entire back surface, and the strip thin-film multilayered electrode 3, placed on the dielectric substrate 2. The thin-film multilayered electrode 3 has a length of $\lambda g/2$ ($\lambda g$ is a guide wavelength) in the longitudinal direction.

The dielectric substrate 2 is a dielectric ceramic substrate mainly composed of $Zn_xSn_{1-x}TiO_4(0 \leqq x \leqq 1)$ (hereinafter referred to as $(Zn,Sn)TiO_4$) having a dielectric constant of 38, and there are many pores with a diameter of approximately 1.0 $\mu$m in the substrate. The surface of the dielectric substrate 2 is uneven or rough at a height of approximately 1 $\mu$m because of the existence of pores or the like.

Figure 2:
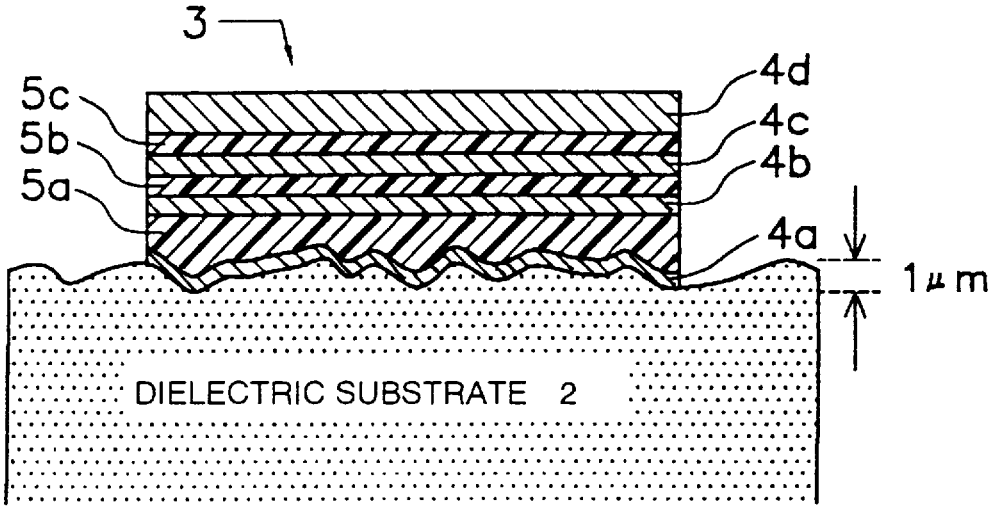
FIG. 2 is a sectional view of the thin-film multilayered electrode as the first example formed on an uneven dielectric substrate.

The thin-film multilayered electrode 3 having a layered structure shown in FIG. 2 is formed on the dielectric substrate 2. The thin-film multilayered electrode 3 includes thin-film conductive layers 4*a*, 4*b*, 4*c*, and 4*d* composed of a metal material such as Cu and thin-film dielectric layers 5*a*, 5*b*, and 5*c* composed of dielectric materials alternately stacked. Each layer may be deposited by, for example, a sputtering process.

Table 1 shows the film structure of the thin-film multilayered electrode 3 in this example, selected for operation at a frequency of 3 GHz.

TABLE 1

| Layer | Symbol | Material | Relative Dielectric Constant | Thickness |
|---|---|---|---|---|
| 4th thin-film conductive layer | 4d | Cu | — | 3.00 $\mu$m |
| 3rd thin-film dielectric layer | 5c | $SiO_2$ | 4 | 0.40 $\mu$m |
| 3rd thin-film conductive layer | 4c | Cu | — | 0.53 $\mu$m |
| 2nd thin-film dielectric layer | 5b | $SiO_2$ | 4 | 0.40 $\mu$m |
| 2nd thin-film conductive layer | 4b | Cu | — | 0.53 $\mu$m |
| 1st thin-film dielectric layer | 5a | $Al_2O_3$ | 10 | 1.22 $\mu$m |
| 1st thin-film conductive layer | 4a | Cu | — | 0.53 $\mu$m |

As a comparative example, with respect to a thin-film multilayered electrode in which only $SiO_2$ having a relative dielectric constant of 4 is used for the thin-film dielectric layers, the values designed in accordance with the method disclosed in PCT Patent Publication No. WO95/06336, also selected for operation at a frequency of 3 GHz, are shown in Table 2.

TABLE 2

| Layer | Material | Relative Dielectric Constant | Thickness |
|---|---|---|---|
| 4th thin-film conductive layer | Cu | — | 3.00 μm |
| 3rd thin-film dielectric layer | $SiO_2$ | 4 | 0.40 μm |
| 3rd thin-film conductive layer | Cu | — | 0.53 μm |
| 2nd thin-film dielectric layer | $SiO_2$ | 4 | 0.40 μm |
| 2nd thin-film conductive layer | Cu | — | 0.53 μm |
| 1st thin-film dielectric layer | $SiO_2$ | 4 | 0.40 μm |
| 1st thin-film conductive layer | Cu | — | 0.53 μm |

As can be seen from Table 1, with respect to the thin-film multilayered electrode 3 in this example, the first thin-film dielectric layer 5*a* which lies closest to the surface of the dielectric substrate 2 is made of a different material from the other thin film dielectric layers 5*b* and 5*c* and is formed considerably thicker in comparison with the other thin-film dielectric layers 5*b* and 5*c*. The reason is that the unevenness of the surface of the dielectric substrate 2 is planarized by forming the film thickly.

According to an intensive study by the inventors of the present invention, in the case where a film is deposited on a substrate having pores on the surface thereof, if the thickness of the film becomes at least about 1.5 times as great as the average size of the pores, the unevenness is planarized and the top surface of the film becomes flat and smooth.

Therefore, it might be possible to form a leveling layer on a dielectric substrate so that the leveling layer has a thickness greater than the size of the pores which are located on the surface of the dielectric substrate. However, this would complicate the design of the thin-film multilayered electrode due to the existence of the leveling layer. It is also disadvantageous to require another production step to form the leveling layer.

In view of the foregoing, the inventors have found that it is advantageous for the first thin-film dielectric layer closest to the dielectric substrate to be made of a material having a greater dielectric constant and to be made thicker, thereby providing a planarized top surface of the thin-film dielectric layer closest to the dielectric substrate, as explained above. Referring to Table 1 and FIG. 2, according to the structure shown, since the sum of the thickness of the first thin-film dielectric layer 5*a* and the first thin-film conductive layer 4*a* is greater than 1.5 times the unevenness at a height of approximately 1 μm (the heights and diameters of the surface irregularities tend to be approximately equal), the thin-film dielectric layers 5*b* and 5*c* and the thin-film conductive layers 4*b*, 4*c* and 4*d* are made flat, thereby preventing the thin-film conductive layers 4*b*, 4*c* and 4*d* from being short-circuited. Note that, although the thin-film conductive layer 4*a* is not planarized, it is possible to prevent the thin-film conductive layer 4*a* from being short-circuited to the thin-film conductive layer 4*b* due to the thicker thin-film dielectric layer 5*a*.

When the thin-film dielectric layer 5*a* is formed thickly as described above, the dielectric material to be used must be changed in accordance with the change in thickness. That is, as the thickness of a thin-film dielectric layer varies, the phase velocity of a TEM wave which propagates through the transmission line formed by the thin-film dielectric layer varies. If there is a change in the phase velocity of a TEM wave which propagates through a transmission line, a shift in phase velocity occurs between the TEM wave and other TEM waves which propagate through other transmission lines, and thus the thin-film dielectric electrode cannot achieve the desired low-loss operation. Therefore, when the thickness of the thin-film dielectric layer is changed, the relative dielectric constant of the dielectric material used must be adjusted so that the phase velocities of TEM waves which propagate through the individual transmission lines are substantially equalized.

In order to determine the optimum relative dielectric constant in response to the film thickness, the following proportionality equation (1) may be used.

$$d_n \propto \frac{1}{\frac{\epsilon_m}{\epsilon_{sn}} - 1} \tag{1}$$

wherein:

$\in_{sn}$: relative dielectric constant of the nth thin-film dielectric layer $d_n$: thickness of the nth thin-film dielectric layer $\in_m$: relative dielectric constant of dielectric substrate In accordance with the design method disclosed in PCT Patent Publication No. WO95/06336, when a thin-film dielectric layer is formed with $SiO_2$ having a relative dielectric constant of 4 on a substrate having a relative dielectric constant of 38, by setting the thickness at 0.4 μm, the phase velocities of the individual transmission lines can be equalized (refer to Table 2). In accordance with the proportionality equation represented by the equation (1), when a thin-film dielectric layer is formed at a thickness of approximately 1.0 μm on a substrate having a relative dielectric constant of 38, by using a dielectric material having a relative dielectric constant of approximately 10, the phase velocities can be equalized. Accordingly, in order to design the thin-film dielectric layer 5*a*, a dielectric material having a relative dielectric constant of 10, for example, $Al_2O_3$, may be formed at a thickness of 1.22 μm.

As described above, since the thin-film dielectric layer lying close to the dielectric substrate is formed thickly so as to planarize the unevenness of the substrate surface, and also the thickness and the relative dielectric constant are set at values which satisfy the above proportionality equation (1), the thin-film multilayered electrode can be formed while absorbing the influence of the unevenness of the substrate, and phase velocities of TEM waves which propagate through the individual transmission lines can be equalized. Also, since the unevenness is planarized by increasing the thickness of the layer, the occurrence of short circuits between individual thin-film conductive layers during the deposition process can be significantly minimized.

EXAMPLE 2

Figure 3:
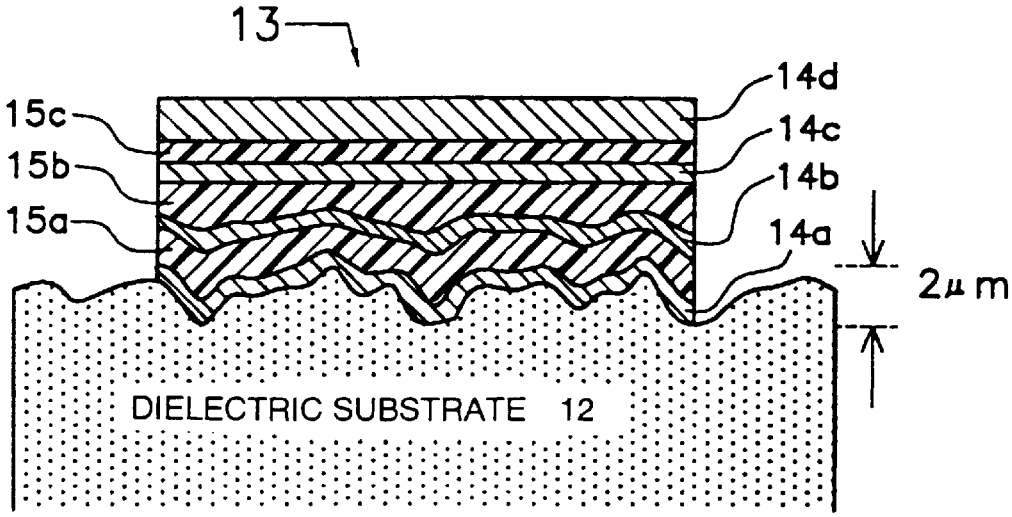
FIG. 3 is a sectional view of a thin-film multilayered electrode as a second example formed on an uneven dielectric substrate.
Figure 4:
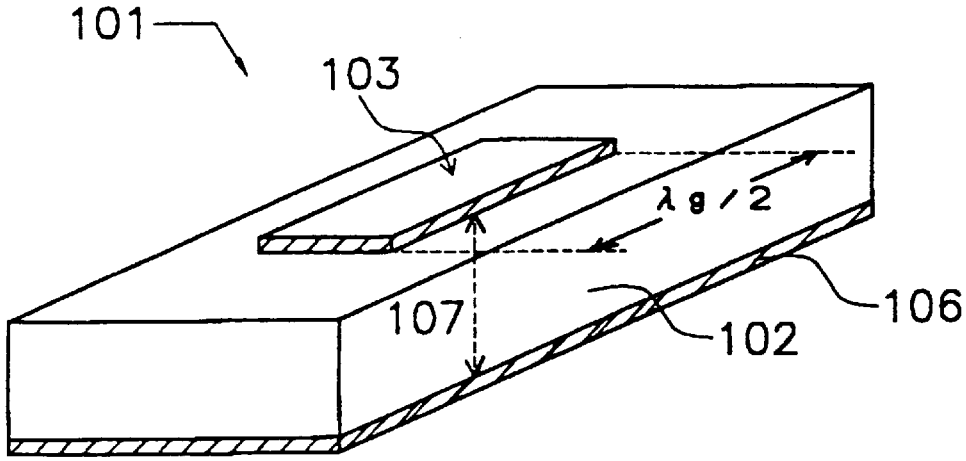
FIG. 4 PRIOR ART
FIG. 4 is a perspective view of a resonator including a conventional thin-film multilayered electrode.
Figure 5:
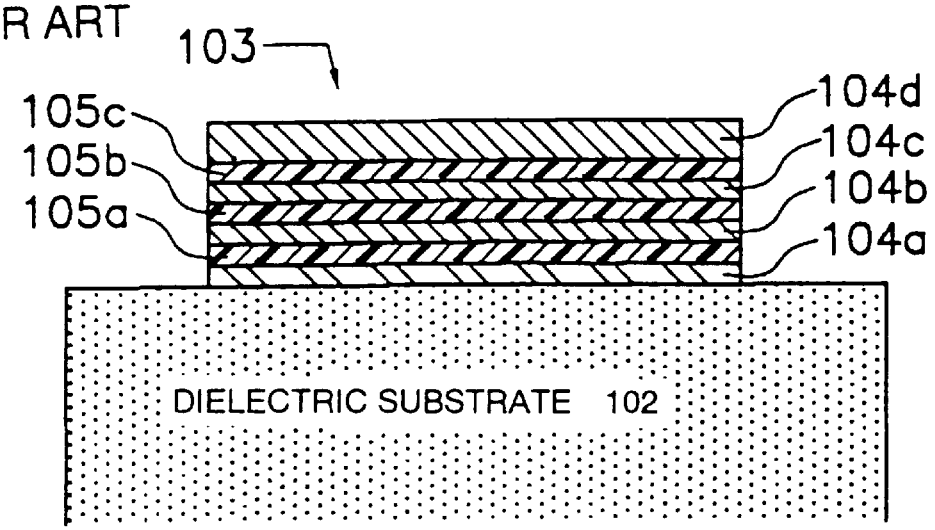
FIG. 5 PRIOR ART
FIG. 5 is a sectional view of a conventional thin-film multilayered electrode formed on an even dielectric substrate.
Figure 6:
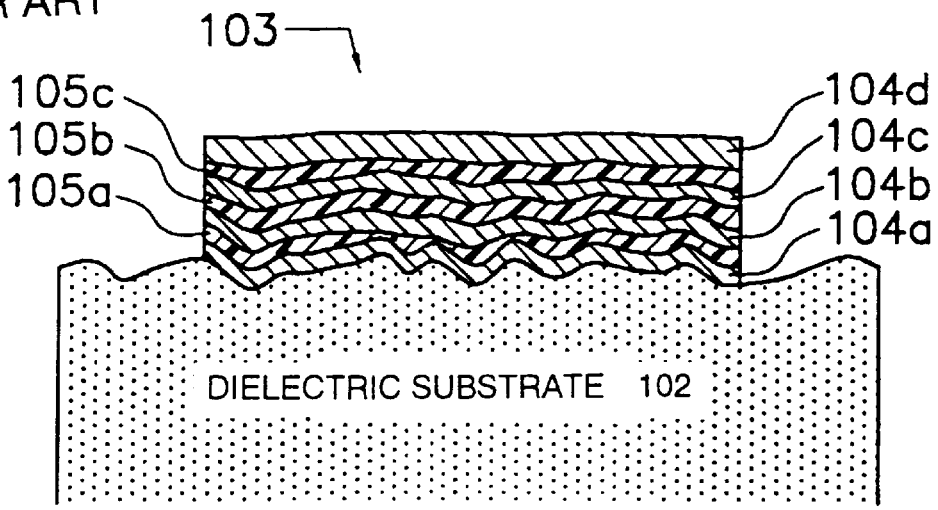
FIG.6 PRIOR ART
FIG. 6 is a sectional view of a conventional thin-film multilayered electrode formed on an uneven dielectric substrate.

A thin-film multilayered electrode as a second example of the present invention will be described with reference to FIG. 3.

In this example, pores in the dielectric substrate 12 have a size with a diameter of approximately 2.0 μm, and the surface of the dielectric substrate 12 has unevenness with a height of approximately 2.0 μm. Therefore, in order to planarize the unevenness of the substrate surface, deposition must be performed up to approximately 3.0 μm from the substrate surface.

Table 3 shows the film structure of a thin-film multilayered electrode 13 for operation at a frequency of 3 GHz.

TABLE 3

| Layer | Symbol | Material | Relative Dielectric Constant | Thickness |
|---|---|---|---|---|
| 4th thin-film conductive layer | 14d | Cu | — | 3.00 μm |
| 3rd thin-film dielectric layer | 15c | $SiO_2$ | 4 | 0.40 μm |
| 3rd thin-film conductive layer | 14c | Cu | — | 0.53 μm |
| 2nd thin-film dielectric layer | 15b | $Al_2O_3$ | 10 | 1.22 μm |
| 2nd thin-film conductive layer | 14b | Cu | — | 0.53 μm |
| 1st thin-film dielectric layer | 15a | $Al_2O_3$ | 10 | 1.22 μm |
| 1st thin-film conductive layer | 14a | Cu | — | 0.53 μm |

As can be seen from Table 3, with respect to the thin-film multilayered electrode 13 in this example, two layers close to the dielectric substrate 12, i.e., thin-film dielectric layers 15*a* and 15*b*, are formed thickly so that the unevenness of the surface of the dielectric substrate 12 is absorbed.

Alternatively, in this example, only the thin-film dielectric layer 15*a* which is closest to the dielectric substrate could be formed thickly so as to planarize the unevenness of the substrate surface in a manner similar to that in Example 1. In such a case, the first thin-film dielectric layer 15*a* would have to be formed at a thickness of approximately 2.5 μm. In order to match the phase velocity, at a thickness of 2.5 μm, with that of the other transmission lines, a dielectric material having a relative dielectric constant of 16 must be used in accordance with the proportionality equation (1) described above. At present, however, there is no dielectric material which has a relative dielectric constant of 16 and which is also suitable for deposition by sputtering. Accordingly, in such a case, by adjusting the thickness of a plurality of thin-film dielectric layers lying close to the substrate surface and by using a suitable sputtering material, the unevenness of the substrate surface may be absorbed. Although the thin-film dielectric layer closest to the substrate surface cannot completely planarize the unevenness of the substrate surface as seen in Example 1 (slight unevenness remains), the unevenness of the substrate can be absorbed to a considerable degree, resulting in no problem in practical use.

Other Examples

The present invention is not limited to the examples described above, and within the scope not deviating from the spirit of this invention, various alterations can be made. For example, although the examples described above refer to a high-frequency half-wavelength transmission line-type resonator including the thin-film multilayered electrode in accordance with the present invention, the resonator may also function as a high-frequency filter by being provided with input and output electrodes represented by numeral 8 shown in FIG. 1. Additionally, a plurality of resonators may be placed on a dielectric substrate to fabricate a multiple-stage filter. Also, the thin-film multilayered electrode in accordance with the present invention may be used as a transmission line.

Moreover, although the thin-film multilayered electrodes explained in the above-explained examples are structured so as to have a TEM mode principal transmission line 7 and TEM mode sub-transmission lines, the thin-film multilayered electrodes of the present invention may be so constructed as to include a TM mode principal resonator and TM mode sub-resonators by the design method disclosed in WO95/06336.

As described above, in accordance with the thin-film multilayered electrode of the present invention, the following tremendous advantages can be obtained.

That is, while the relative dielectric constant of a dielectric material used is selected in accordance with the above-mentioned proportionality equation (1), a thin-film dielectric layer lying close to a dielectric substrate is formed thickly, and thus a thin-film multilayered electrode can be formed with the influence of the unevenness of the substrate being absorbed, and the phase velocities of TEM waves which propagate through the individual transmission lines can be equalized as originally designed. Also, since the unevenness of the substrate is absorbed and planarized, there is no possibility of short circuits between thin-film conductive layers during the deposition process for each layer. Also, the thin-film dielectric layer, in which the thickness is adjusted in accordance with the above-mentioned proportionality equation (1), is not limited to a thin-film dielectric layer lying closest to the substrate surface, and the thickness of a plurality of thin-film dielectric layers may be adjusted as required. This extends the ranges of choices with respect to the dielectric material which can be used for planarizing the unevenness of the substrate.

Also, by using the thin-film multilayered electrode described above, a high-frequency transmission line, a high-frequency resonator, and a high-frequency filter which achieve low-loss operation resulting from the thin-film multilayered electrode can be obtained.

While preferred embodiments of the invention have been disclosed, various modes of carrying out the principles disclosed herein are contemplated as being within the scope of the following claims. Therefore, it is understood that the scope of the invention is not to be limited by the disclosed embodiments.

What is claimed is:

1. A thin-film multilayered electrode comprising:

a dielectric substrate;

a ground conductor provided on a back surface of the dielectric substrate; and a plurality of thin-film conductive layers and dielectric layers alternately stacked on a front surface of the dielectric substrate, wherein the ground conductor, one of the thin-film conductive layers in contact with the dielectric substrate and the dielectric substrate interposed therebetween form a principal transmission line or resonator, and each additional thin-film dielectric layer and a pair of thin-film conductive layers sandwiching said additional thin-film dielectric layer form a respective sub-transmission line or sub-resonator, wherein a thickness and a dielectric constant of each thin-film dielectric layer is set such that phase velocities of waves which propagate through the principal transmission line or resonator and the sub-transmission lines or sub-resonators are substantially identical with each other;

wherein a thickness of each thin-film conductive layer is set at a predetermined value which is smaller than a skin depth at a predetermined operating frequency such that electromagnetic fields between the principal transmission line or resonator and its adjacent sub-transmission line or sub-resonator and between each adjacent pair of sub-transmission lines or sub-resonators are coupled with each other; and wherein one of the thin-film dielectric layers, which is the thin-film dielectric layer closest to the dielectric substrate, has a thickness greater than that of the other thin-film dielectric layers.

2. A thin-film multilayered electrode according to claim 1, wherein said thin-film dielectric layer closest to the dielectric substrate has a dielectric constant greater than that of the other thin-film dielectric layers.

3. A thin-film multilayered electrode according to claim 2, wherein the dielectric substrate has pores which exist on the front surface thereof, and a sum of a thickness of the thin-film conductive layer in contact with the dielectric substrate and a thickness of the thin-film dielectric layer closest to the dielectric substrate is at least 1.5 times as great as an average diameter of said pores.

4. A thin-film multilayered electrode according to claim 1, wherein the dielectric substrate has pores which exist on the front surface thereof, and a sum of a thickness of the thin-film conductive layer in contact with the dielectric substrate and a thickness of the thin-film dielectric layer closest to the dielectric substrate is at least 1.5 times as great as an average diameter of said pores.

5. A thin-film multilayered electrode according to claim 1, wherein said thin-film dielectric layer closest to the dielectric substrate and also a thin-film dielectric layer second closest to the dielectric substrate each have thicknesses greater than that of the other thin-film dielectric layers.

6. A thin-film multilayered electrode according to claim 5, wherein said closest and second closest thin-film dielectric layers each have a dielectric constant greater than that of the other thin-film dielectric layers.

7. A thin-film multilayered electrode according to claim 6, wherein a sum of a thickness of the thin-film dielectric layer closest to the dielectric substrate, a thickness of a thin-film dielectric layer second closest to the dielectric substrate, a thickness of the thin-film conductive layer in contact with the dielectric substrate and a thickness of one of the thin-film conductive layers between the thin-film dielectric layer closest to the dielectric substrate and the thin-film dielectric layer second closest to the dielectric substrate is at least 1.5 times as great as an average diameter of pores which exist on the front surface of the dielectric substrate.

8. A thin-film multilayered electrode according to claim 5, wherein a sum of a thickness of the thin-film dielectric layer closest to the dielectric substrate, a thickness of a thin-film dielectric layer second closest to the dielectric substrate, a thickness of the thin-film conductive layer in contact with the dielectric substrate and a thickness of one of the thin-film conductive layers between the thin-film dielectric layer closest to the dielectric substrate and the thin-film dielectric layer second closest to the dielectric substrate is at least 1.5 times as great as an average diameter of pores which exist on the front surface of the dielectric substrate.

9. A thin-film multilayered electrode according to claim 1, wherein a sum of a thickness of the thin-film dielectric layer closest to the dielectric substrate, a thickness of a thin-film dielectric layer second closest to the dielectric substrate, a thickness of the thin-film conductive layer in contact with the dielectric substrate and a thickness of one of the thin-film conductive layers between the thin-film dielectric layer closest to the dielectric substrate and the thin-film dielectric layer second closest to the dielectric substrate is at least 1.5 times as great as a diameter of pores which exist on the front surface of the dielectric substrate.

10. A high-frequency filter comprising:

a thin-film multilayered electrode comprising:

a dielectric substrate;

a ground conductor provided on a back surface of the dielectric substrate; and a plurality of thin-film conductive layers and dielectric layers alternately stacked on a front surface of the dielectric substrate, wherein the ground conductor, one of the thin-film conductive layers in contact with the dielectric substrate and dielectric substrate interposed therebetween form a principal transmission line or resonator, and each additional thin-film dielectric layer and a pair of thin-film conductive layers sandwiching said additional thin-film dielectric layer form a respective sub-transmission line or sub-resonator, wherein a thickness and a dielectric constant of each thin-film dielectric layer is set such that phase velocities of waves which propagate through the principal transmission line or resonator and the sub-transmission lines or sub-resonators are substantially identical with each other;

wherein a thickness of each thin-film conductive layer is set at a predetermined value which is smaller than a skin depth at a predetermined operating frequency such that electromagnetic fields between the principal transmission line or resonator and its adjacent sub-transmission line or sub-resonator and between each adjacent pair of sub-transmission lines or sub-resonators are coupled with each other; and wherein one of the thin-film dielectric layers, which is the thin-film dielectric layer closest to the dielectric substrate, has a thickness greater than that of the other thin-film dielectric layers;

said thin-film multilayered electrode having two ends; and an input terminal and an output terminal disposed for being electromagnetically coupled to respective ones of said two ends.

* * * * *